US005082528A

United States Patent [19]

Hartman

[11] Patent Number: 5,082,528

[45] Date of Patent: Jan. 21, 1992

[54] IRON SALTS AS RETENTION AGENTS

[75] Inventor: Neil A. Hartman, Slidell, La.

[73] Assignee: Eaglebrook, Inc., Slidell, La.

[21] Appl. No.: 624,327

[22] Filed: Dec. 7, 1990

[51] Int. Cl.[5] ..... D21H 17/64

[52] U.S. Cl. ..... 162/175; 162/178; 162/180; 162/181.2; 162/181.3; 162/181.5

[58] Field of Search ..... 162/181.2, 181.3, 181.5, 162/158, 175, 178, 180

[56] References Cited

U.S. PATENT DOCUMENTS 1,935,196 11/1933 Lathrop et al. ..... 162/181.2
2,388,487 11/1945 Linzell ..... 162/181.3
3,151,019 9/1964 Shildneck et al. ..... 162/181.5

FOREIGN PATENT DOCUMENTS 619640 5/1961 Canada ..... 162/181.2
1175611 10/1983 Canada ..... 162/181.2
57-35097 2/1982 Japan ..... 162/181.2

*Primary Examiner*—Peter Chin
*Attorney, Agent, or Firm*—Rockey and Rifkin

[57] ABSTRACT

Iron salts hydrolyzable to ferric hydroxide are provided as retention agents for size in the production of paper and paperboard to aid in water repellence, reduce pollutants, and create other beneficial effects.

15 Claims, No Drawings

IRON SALTS AS RETENTION AGENTS

The present invention relates to the use of iron salts as retention agents in the manufacture of paper, the primary purpose of which is to retain rosin size and thereby to cause the paper to become water repellent. The iron salts of the present invention also advantageously act as retention agents for other chemical additives and so-called "fines"—finely divided materials found in the process water of paper producing equipment.

The iron salts of the present invention have equal applicability to the production of paperboard, and as used herein, "paper" shall be deemed to include paperboard.

BACKGROUND OF THE INVENTION

Rosin and alum sizing of paper and paperboard has been well established in the art for many years, and is widely employed to produce water repellent paper products. The production of such papers uses rosin size, which is obtained from "tall oil," a naturally occurring product extracted from soft wood trees such as pines. This oil is saponified by the addition of caustic soda to produce the sodium salt of the oil, or rosin soap. Rosin soap is also produced as a byproduct of the alkaline pulping of soft woods, and is found in various concentrations in unbleached kraft soft wood pulp. This material is used extensively in food wraps and other papers and paperboard in which water repellence is desirable.

Although the pulp, or "stock" as it is called in the art, contains a certain concentration of rosin soap, it is common practice to disperse additional rosin soap in the stock, to further increase the water repellent characteristics of the paper to be produced. The rosin soap may be modified chemically to increase its ability to repel water, to promote dispersion into stock, to put the rosin in oil form before it is used, and to produce aqueous dispersions having high rosin content to facilitate shipping at low costs.

In order to retain, or set, the rosin in the paper during the manufacturing process, when water is removed from the stock, a retention agent is added to the stock. Such retention agents commonly include polymers and, more commonly, alum ($Al_2(SO_4)_3$), which is typically provided in an aqueous solution 27 percent by weight anhydrous $Al_2(SO_4)_3$. When added to sufficient quantities of water, alum hydrolyzes to form aluminum hydroxide and sulfuric acid. The sulfuric acid thus formed lowers the stock pH. As the stock pH becomes acid, the rosin soap is converted to rosin oil, which is also commonly known as rosin size. The aluminum hydroxide retains the rosin size.

Rosin size may be chemically modified, as noted above to enhance certain characteristics such as water repellency. In addition, there are artificial sizes, such as AKD (alkyl ketene dimer) or ASA (alkynyl succinic anhydride), that are substitutes for rosin size.

At the same time, the aluminum hydroxide thus produced acts to flocculate rosin size onto the paper fibers in the wet stock. This compound also acts as a retention agent for anionic substances such as rosin size, retaining the size on the paper fibers even as water is removed from the stock; it most efficaciously serves this purpose at a pH range of 4.0 to 5.5. In order to lower the stock pH sufficiently to cause the aluminum hydroxide to act as a retention agent, additional sulfuric acid is commonly added to the stock. It has been shown that this process typically requires two pounds of alum ($Al_2(SO_4)_3 \cdot 18H_2O$) to set one dry pound of rosin size.

The rosin size thus retained in the dry paper is an oil that causes the finished paper to repel water.

The aluminum hydroxide also provides other functions resulting from flocculation of not only paper fibers but also fines. Notably, increased flocculation results in better drainage of water from the stock (measured as "freeness"), resulting in faster and easier drying of the stock into paper.

Another function of the addition of alum is that gums, fillers, starches, dry strength additives and other additives used to impart desirable properties in the finished paper are retained with the fibers, reducing the presence of such materials in the process water. In addition, as a result of retention of the materials in the paper, these additives may be used more effectively and economically.

All of this results in lower concentrations of pollutants in effluent waste streams, lower head box consistency, and lower head box freeness. This also results in less loss of stock and facilitates solid waste removal using clarifiers, savealls, screens or filters.

Unfortunately, alum is an expensive material, costing up to hundreds of dollars per ton of material. This represents an increase in the cost of materials employed in the production of water repellent papers, adding significantly to the cost of each ton of paper produced with alum.

Another problem is that alum also operates efficaciously as a flocculant only in a narrow, acidic pH range from 4.0 to 5.5. In this range, the acidic stock corrodes the extremely expensive paper making equipment, requiring repair or replacement of the equipment and shutting down production while repair or replacement is occurring. Alternatively, expensive acid resistant materials are used in such equipment, adding to their cost.

A problem also results from the deposition of aluminum hydroxide on the paper making equipment as the stock is converted to paper, frequently shutting down the equipment for cleaning. Expensive chemicals specially prepared for removal of aluminum hydroxide are required to clean the equipment and return it to service.

Moreover, alum is a very hygroscopic material, and as such detrimentally increases the time and cost to dry the paper.

For these reasons, it has long been felt by those in the paper industry that a cost-effective substitute for alum as a retention aid for rosin size was desirable.

Recently, it is also believed by some medical experts that aluminum and aluminum salts play a role in Alzheimer's disease, a serious affliction impairing the physical and mental abilities of thousands of persons each year. Since many of the products in which alum is employed as a retention agent are used in food packaging, a potential health threat resulting from the use of this material may exist. Alum is also present in the atmosphere surrounding paper production equipment, thereby posing a health risk to workers using such equipment.

SUMMARY OF THE INVENTION

It has now been demonstrated that iron salts that are hydrolyzable to ferric hydroxide (Fe(OH)3) may be used to retain rosin size in the production of water repellent paper. More specifically, it has been found that hydrolyzable ferric and ferrous salts may beneficially be employed as retention agents in paper production with substantial advantages over alum. These salts may be used to retain not only rosin size, but also modified rosin size, man-made sizing agents, starches, modified starches, gums, modified gums, and other additives and fines. These salts also enhance freeness and water removal by retaining fibers and fines, aiding in drying of the paper or paperboard.

Thus, the present invention provides a process for producing paper or paperboard, comprising the steps of providing stock suitable for making paper, adding rosin size to the stock, adding to the stock an iron salt hydrolyzable to ferric hydroxide, mixing the stock, size and iron salt, and forming paper from the stock.

It is an object of the present invention to employ hydrolyzable iron salts to produce water repellent paper products.

It is another object of the invention to provide a low cost additive, in the form of an iron salt, as a retention agent for rosin size.

It is still another object of the invention to provide such a retention agent that beneficially and substantially increases the retention of rosin size, fibers, fines, and other additives as compared to alum.

A further object of the invention is to provide a retention agent that improves the water quality from effluent streams of paper production facilities by reducing the presence of pollutants in such streams.

Another important object of the invention is to provide a retention agent that operates efficaciously at higher pH than alum, thereby to reduce corrosion resulting from low pH conditions.

These and other objects of the invention will be apparent from the detailed description of the invention provided below.

DETAILED DESCRIPTION OF THE INVENTION

The present invention uses iron salts that may be hydrolyzed to ferric hydroxide as retention agents for rosin size and other additives in the production of water repellent papers. Such salts include, without limitation, ferric and ferrous sulfate, ferric and ferrous chloride, and other iron salts. In addition, ferric hydroxide may itself be employed in the present invention.

In using ferrous salts, it is recognized that a oxidizing agent must be present in order to hydrolyze the salt to ferric hydroxide. Suitable oxidizing agents include, without limitation, dissolved air or oxygen, peroxides, and any other well-known substances that function as oxidizing agents.

Upon dissolving the iron salt in water (with an oxidizing agent if the salt is a ferrous derivative), the iron salt is hydrolyzed to form ferric hydroxide, which is insoluble in water. Hydrolysis is dependent upon pH, temperature, water hardness and the concentration of ferric ion in the water. In general, ferric hydroxide will form when the ferric ion content of the water is less than 0.6 grams per liter.

In the preferred embodiment, the iron salt employed is ferric sulfate. One commercial formulation of this salt is sold by Eaglebrook, Inc. under the trademark FERRICLEAR TM as an aqueous solution of $Fe_{10}(SO_4)_{14}OH$ that is 12 percent ferric iron by weight.

For effective sizing, the ferric sulfate is added to the stock in quantities that vary in accordance with three factors: the pH desired, the type of size being added and the extent of substances that interfere with the retention of size. It is believed that the advantages of the present invention may be realized by using between 0.1 and 4.0 pounds of ferric iron per pound of dry sizing material depending upon these factors, and it conceivable that other quantities may successfull be employed.

It is anticipated that at least 2.4 pounds of liquid ferric sulfate having a 12 percent ferric iron content are needed to set one pound of dry rosin size. This corresponds to 0.29 pounds of ferric iron per pound of dry rosin size, as compared with 2 pounds dry alum per pound of rosin size.

For increased freeness of the stock, 0.6–2.4 pounds of ferric iron per ton of paper were evaluated, corresponding to a feed rate of 10–40 pounds of FERRICLEAR per ton of paper. This evaluation demonstrated substantial increases in freeness of the stock.

The iron salt may be added to the stock as a solution, a solid, or in a stream of water that is added to the stock.

As will be shown from the examples below, the sequence for combining the rosin size and the retention agent with the stock is unimportant. In general, either the retention agent or the rosin size may be added to the stock first, without deleterious effect upon the water repellence and other characteristics of the resulting paper. Specific modified rosin sizes, however, may have characteristics that require that either the size or the retention agent be added first to produce the desired retention and other effects, and certain equipment may also require or prefer a given sequence of addition.

The point at which the iron salt will be added will vary depending upon the particular paper being made and the fabrication process employed, but should in all cases be prior to the sheet forming area. Factors related to this determination include the type of size being used, the presence of substances that interfere with the retention of size, other desired effects, the type of paper being manufactured, the type of stock being used and the equipment employed.

Tests (Examples I-VI) were run on Ultrex 300 (Austell Box Board, Inc.) stock using NovaSperce 0935 (Georgia Pacific Corp.) modified rosin size. NovaSperce 0935 is an emulsion that is 35 percent modified rosin size by weight, and was employed in quantities of 10 wet pounds (3.5 dry pounds) per ton of dry stock. The stock had been washed with hot water and its temperature was 125° F. when the NovaSperce was added. After addition of NovaSperce, the stock was mixed well and divided into two portions. In the first portion, the pH was adjusted to 5.2 using alum; in the second portion, the pH was adjusted to 5.2 with FERRICLEAR. Additional quantities of alum or FERRICLEAR were added as summarized in Table I, and a water drop test was run on handsheets produced from each sample. As shown in Table I, the use of ferric sulfate resulted in a paper having superior water repellence when compared to an alum treated paper.

EXAMPLE I

Stock pH was returned to 5.2 using alum. No more alum was added to the stock.

EXAMPLE II

Stock pH was returned to 5.2 using alum. Additional alum was added at a ratio of 40 pounds per ton of dry stock.

EXAMPLE III

Stock pH was returned to 5.2 using alum. Additional alum was added at a ratio of 80 pounds per ton of dry stock.

EXAMPLE IV

Stock pH was returned to 5.2 using FERRICLEAR. No more FERRICLEAR was added the stock.

EXAMPLE V

Stock pH was returned to 5.2 using FERRICLEAR. Additional FERRICLEAR was added at a ratio of 40 pounds per ton of dry stock.

EXAMPLE VI

Stock pH was returned to 5.2 using FERRICLEAR. Additional FERRICLEAR was added at a ratio of 80 pounds per ton of dry stock.

TABLE I

| Example No. | NovaSperce Present (lb/ton dry stock) | Additive Present (lb/ton dry stock) | Adsorption Time (minutes) Top | Bottom | Average |
|---|---|---|---|---|---|
| I | 10 | 0 (alum) | 40 | 49 | 44.5 |
| II | 10 | 40 (alum) | 150 | 75 | 112.5 |
| III | 10 | 80 (alum) | 170 | 35 | 102.5 |
| IV | 10 | 0 (iron) | 205 | 117 | 156 |
| V | 10 | 40 (iron) | 162 | 117 | 144.5 |
| VI | 10 | 80 (iron) | 196 | 119 | 157.5 |

In addition to retaining rosin size in such a way that it causes the paper to repel water, the ferric hydroxide flocculant also increases the freeness of the stock. In Examples VII–XII, stock was prepared in a commercial pulper from corrugated boxes. Pulper dilution water came from the underflow of the clarifier servicing a paper machine with alum in use. Refined stock samples were obtained prior to the addition of alum. Measured amounts of alum and iron salt (FERRICLEAR) were added to the stock and stirred for 30 seconds, and freeness was then measured using a Canadian Standard Freeness Tester. As summarized in Table II, the resulting data shows the freeness increases as a result of the use of iron salts as compared to the use of alum. This increase in freeness makes water removal easier, meaning that less energy will be expended in drying the paper, and associated costs will be reduced.

TABLE III

| Example No. | Additive | Quantity added (lb/ton) | No. of tests | Average increase in freeness |
|---|---|---|---|---|
| VII | alum | 10 | 6 | 1.3% |
| VIII | alum | 20 | 5 | 4.6% |
| IX | alum | 40 | 5 | 0.5% |
| X | FERRICLEAR | 10 | 6 | 5.8% |
| XI | FERRICLEAR | 20 | 5 | 8.7% |
| XII | FERRICLEAR | 40 | 5 | 8.2% |

Additional testing has shown that clarification of effluent streams will be enhanced by use of iron salts as compared to alum, advantageously resulting in lower costs due to greater recovery of solids, and savings in pollution control as a result of the reduction of pollutants in waste streams. Examples XIII and XIV indicate the advantages of using iron treated stock to produce a greater quantity of supernatant, and a clearer supernatant, as compared to alum treated stock.

EXAMPLE XIII 1000 ml stock, consisting of 997 g water and 3 g dry stock (with 10 lb. size, 20 lb. liquid alum per ton of dry stock), and having a pH of 4.5, was placed in a graduated cylinder and allowed to settle for 10 minutes. At the end of that period, the stock had settled to the 950 line of the graduated cylinder, producing 50 ml supernatant. This supernatant was very cloudy.

EXAMPLE XIV 1000 ml stock, consisting of 997 g water and 3 g dry stock (10 lb. size, 20 lb. FERRICLEAR per ton dry stock), and having a pH of 6.0, was placed in a graduated cylinder and allowed to settle for 10 minutes. At the end of that period, the stock had settled to the 850 ml line of the graduated cylinder, producing 150 ml supernatant. This supernatant was quite clear, although brown in color (characteristic of the ferric iron present).

Importantly, the iron salts of the present invention may be used efficaciously at a pH range above 6.0, providing a substantial advantage over more acidic operations using alum. This will, it is believed, lower costs to paper manufacturers by prolonging the life of paper-making equipment, reducing the frequency of repairs due to acid corrosion of the equipment, allowing the equipment to be made from less expensive materials, and reducing down time resulting from corrosion.

The iron salts of the present invention also eliminate the health risks posed by the us of aluminum salts.

Another advantage of iron salts is their ability to enhance the color of unbleached papers. This is the result of the reddish-brown color of the iron salts, which compliments the gray or brown color of the unbleached paper. The resulting paper is an attractive brown shade.

The present invention has been described with respect to certain embodiments and conditions, which are not meant to and should not be construed to limit the invention. Those skilled in the art will understand that variations from the embodiments and conditions described herein may be made without departing from the invention a claimed in the appended claims.

What is claimed is:

1. A process for producing internally sized paper comprising the steps of:

providing a stock suitable for the production of paper;

adding a sizing material to the stock to impart water repellence to paper produced from the stock;

adding to the stock a solution of a partially hydroxylated iron salt hydrolyzable to ferric hydroxide;

mixing the stock, size and iron salt solution together and hydrolyzing said iron salt to ferric hydroxide; and forming paper from the mixture, whereby the paper so produced is internally sized.

2. The process of claim 1, wherein the solution is prepared by adding a solid form of the iron salt to a stream of water added to the stock.

3. The process of claim 1, wherein the sizing material is a chemically modified rosin size.

4. The process of claim 1, wherein the sizing material is an artificial size that imparts water repellence in paper.

5. The process of claim 1, wherein the quantity of ferric iron added to the stock is less than three pounds of dry ferric iron per pound of dry sizing material.

6. The process of claim 1, wherein the quantity of ferric iron added to the stock is more than 0.1 pound of dry ferric iron per pound of dry sizing material.

7. The process of claim 1, wherein the quantity of ferric iron added to the stock is about 0.29 pound of dry ferric iron per pound of dry sizing material.

8. The process of claim 1, wherein the mixture further comprises at least one component selected from the group consisting of starches, modified starches, gums, modified gums, dry strength additives and fines.

9. A paper produced by the process of claim 1.

10. A process for producing internally sized water repellent paper, comprising the steps of:

providing a stock suitable for making paper;

adding rosin size to the stock;

adding to the stock a solution of partially hydroxylated ferric sulfate;

mixing the stock, size and ferric sulfate solution together and hydrolyzing the ferric sulfate to ferric hydroxide; and forming paper from the mixture, whereby the paper so produced is internally sized.

11. The process of claim 10, wherein the quantity of ferric iron added to the stock is about 0.29 pounds per pound of rosin size.

12. A paper produced by the process of claim 10.

13. A process for producing internally sized paper comprising the steps of:

providing a stock suitable for the production of paper;

adding a sizing material to the sock to impart water repellence to paper produced form the stock;

adding to the stock a partially hydroxylated iron salt in dry form which is hydrolyzable to ferric hydroxide;

mixing the stock, size and iron salt solution together and hydrolyzing said iron salt to ferric hydroxide; and converting the mixture into paper whereby the paper so produced is internally sized.

14. The process of claim 13, wherein the iron salt is added to a stream of water that is added to the stock.

15. A paper produced by the process of claim 13.

* * * * *